US007823707B2

(12) United States Patent
Lindberg

(10) Patent No.: US 7,823,707 B2
(45) Date of Patent: Nov. 2, 2010

(54) GUIDE DEVICE FOR AN ELEVATOR, ELEVATOR WITH SUCH A GUIDE DEVICE, AND METHOD FOR OPERATING SUCH AN ELEVATOR

(75) Inventor: Bjarne Lindberg, Adligenswil (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/848,420

(22) Filed: Aug. 31, 2007

(65) Prior Publication Data

US 2008/0053755 A1 Mar. 6, 2008

(30) Foreign Application Priority Data

Sep. 6, 2006 (EP) ..... 06120226

(51) Int. Cl.
*B66B 7/04* (2006.01)

(52) U.S. Cl. ..... 187/409; 187/343

(58) Field of Classification Search ..... 187/409, 187/410, 357, 294, 343
See application file for complete search history.

(56) References Cited

U.S. PATENT DOCUMENTS 857,725 A * 6/1907 Donohoe ..... 187/409
1,803,762 A * 5/1931 Marks ..... 187/376
2,260,728 A * 10/1941 Somervell ..... 187/409
2,308,210 A 1/1943 Sahlin
2,618,361 A * 11/1952 Zindt ..... 187/372
3,554,327 A * 1/1971 Takamura et al. ..... 187/409
4,865,157 A * 9/1989 Sissala ..... 187/410
5,086,882 A * 2/1992 Sugahara et al. ..... 187/410
5,628,385 A * 5/1997 Yumura et al. ..... 187/373
6,510,925 B1 1/2003 DeJong

FOREIGN PATENT DOCUMENTS

CH 662 106 A2 9/1987
EP 1 593 641 A1 9/2000
GB 2 270 292 A * 3/1994
JP 53131641 A * 11/1978
JP 54-162350 A * 12/1979
JP 04-153-179 A * 5/1992
JP 06156937 A * 6/1994

* cited by examiner

*Primary Examiner*—Thomas J. Brahan
(74) *Attorney, Agent, or Firm*—Fraser Clemens Martin & Miller LLC; William J. Clemens

(57) ABSTRACT

A guide device for an elevator car has a guide shoe that is displaceable by a linear guide that is arranged on the elevator car. Should the elevator car in an extreme situation travel beyond the uppermost floor, the guide shoe is arrested by a projecting console, and the elevator car travels past the console. The linear guide permits the guide shoe to execute a movement relative to the elevator car. Thus, the elevator car, or parts thereof, utilizes the hoistway headroom that is provided for the drive unit or other hoistway equipment. The counterweight can be provided with the displaceable guide shoe for utilizing the hoistway pit in a similar manner.

9 Claims, 4 Drawing Sheets

GUIDE DEVICE FOR AN ELEVATOR, ELEVATOR WITH SUCH A GUIDE DEVICE, AND METHOD FOR OPERATING SUCH AN ELEVATOR

FIELD OF THE INVENTION

This invention relates to a guide device for an elevator with an elevator car, a counterweight, and a drive unit, wherein suspension means that are guided over a traction sheave of the drive unit suspend and move the elevator car and the counterweight that are guided on guide rails by means of guide shoes.

BACKGROUND OF THE INVENTION

EP 1 593 641 A1 shows an elevator with an elevator car and a counterweight that can be moved up and down by suspension means that are guided over a traction sheave. The traction sheave that is arranged in a housing is connected to a motor that executes a rotational motion. The elevator car and the counterweight are guided on guide rails, the counterweight guide rails and a car guide rail supporting a console support on which a console is arranged. The traction sheave housing rests on the console. Flanged onto one end of the traction sheave housing is the motor and onto the other end a brake. The car guide rail extends under the console, as a result of which, when the elevator car is raised, the car guide shoe cannot reach further than under the console.

SUMMARY OF THE INVENTION

The present invention provides a solution to the task of creating a guide device by means of which the hoistway space can be better used for the elevator car and/or for the counterweight.

The advantages obtained from the present invention are mainly that a better spatial utilization of the hoistway headroom or hoistway pit is possible, which in turn allows a more independent placement of the elevator in the building. Additionally advantageous is that the distance between the upper and lower car guide shoe can be enlarged, which in turn in normal operation results in quieter running since the displaceable guide shoe is only displaced in extreme situations. The guide device according to the present invention with at least one displaceable guide shoe allows the construction of elevator systems that have minimal hoistway headroom and/or minimal hoistway pit depth, the guide shoe of the elevator car or the guide shoe of the counterweight being displaceable relative to the elevator car and/or the counterweight. In normal operation or normal travel, the guide shoe is normally not displaced relative to the elevator car or the counterweight. In extreme situations, as for example on over travel or when the counterweight strikes the buffer and the elevator car therefore jumps, the guide shoe moves relative to the elevator car and avoids a damage-causing collision with the hoistway equipment that projects into the projection of the elevator car as for example the traction sheave or the console that carries the drive or the drive unit.

In the guide device according to the present invention for an elevator with an elevator car, a counterweight, and a drive unit, wherein suspension means that are guided over a traction sheave of the drive unit suspend and move the elevator car and counterweight that are guided on guide rails by means of guide shoes, at least one guide shoe is provided that is arranged on the elevator car or on the counterweight displaceably relative to the elevator car or relative to the counterweight respectively.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
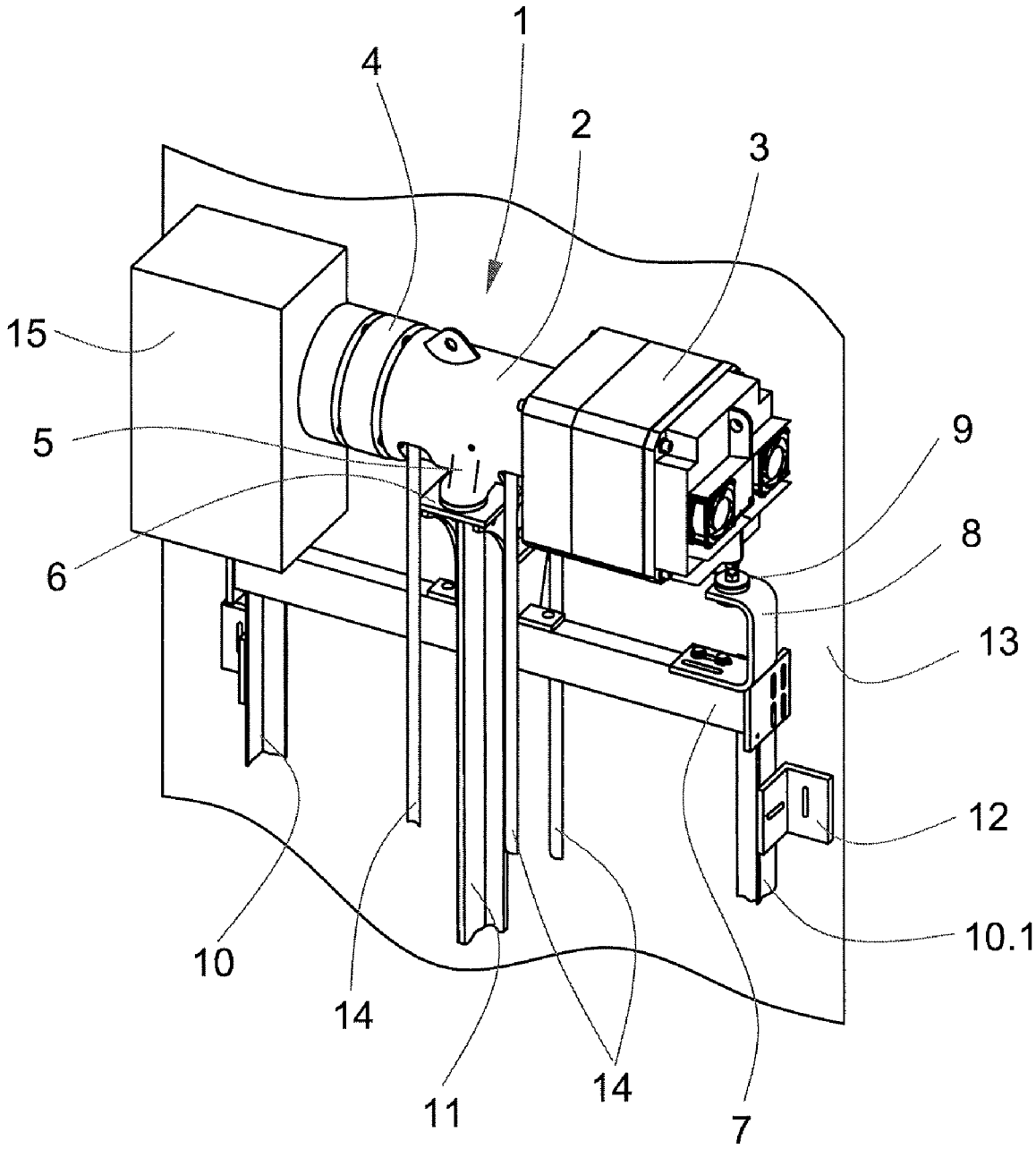
FIG. 1 is a perspective view of a drive unit that is supported by guide rails.

FIG. 1 shows a gearless drive unit 1 comprising a traction sheave that is arranged in a housing 2 and arranged at one end of which is a motor 3 and at the other end a brake 4. The housing 2 rests by means of two machine feet 5 (only the front foot is visible) on a console or platform 6 of a supporting frame 7. Also arranged on the supporting frame 7 is a support 8 that with one of its ends 9 supports the motor 3.

Figure 2:
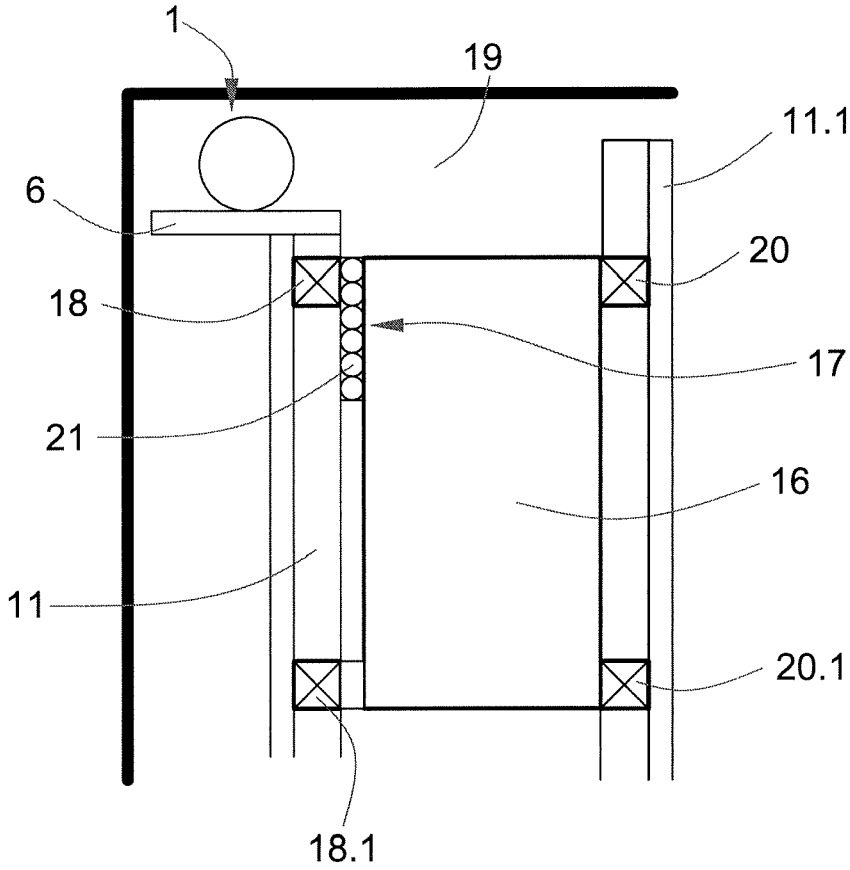
FIGS. 2 and 4 are schematic views of a guide device according to the present invention with a displaceable guide shoe in normal travel.

The supporting frame 7 is borne by guide rails 10, 10.1 of a counterweight 30 (FIG. 3*a*) and by a guide rail 11 of an elevator car 16 (FIG. 2). The guide rails 10, 10.1, 11 are load-bearing and transmit the vertical forces into the floor 31.1 of the hoistway pit 31 (FIG. 4). The horizontal rail forces are transmitted by means of angle brackets 12 into a hoistway wall 13. The guide rails 10, 10.1 of the counterweight 30 end at the supporting frame 7, the guide rail 11 of the elevator car 16 ends at the console 6. Suspension means 14 that are guided over the traction sheave suspend and move the elevator car 16 and the counterweight 30. A control 15 controls the motor 3 and the brake 4 and supplies the motor 3 and brake 4 with electrical energy.

FIG. 2 and FIG. 4 show a guide device 17 according to the present invention with a displaceable guide shoe 18 in normal operation. The elevator car 16 is positioned at the topmost floor, the guide shoe 18 of the elevator car 16 is positioned slightly below the console 6 and held in this position by a returning spring 22. A second guide shoe 18.1 guides the elevator car 16 at the bottom end along the guide rail 11. A second guide rail 11.1 of the elevator car 16 extends into a hoistway headroom 19. The elevator car 16 is guided along the second guide rail 11.1 by means of a third guide shoe 20 and fourth guide shoe 20.1. The second guide shoe 18.1, the third guide shoe 20 and the fourth guide shoe 20.1 are arranged displaceably on the elevator car 16. The guide shoe 18 is arranged movably on the elevator car 16 by means of a linear guide 21. Should the guide shoe 18 touch the console 6, the former comes to rest and thereby executes a relative displacement relative to the elevator car 16.

Figure 3:
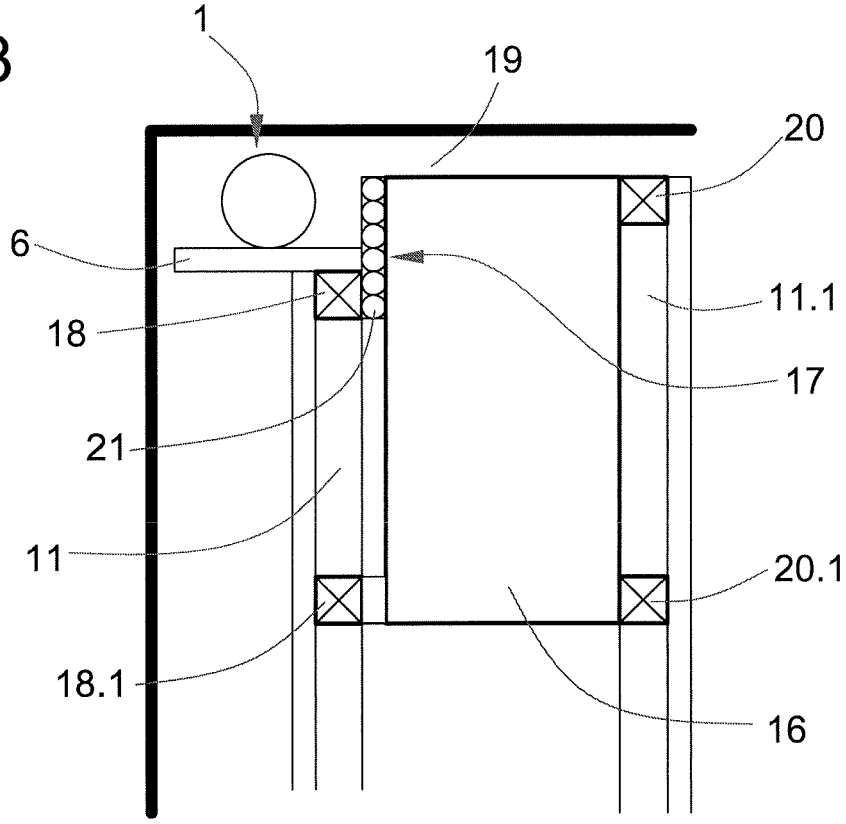
FIGS. 3, 3*a*, and 5 are schematic views of the guide device according to the present invention with the displaceable guide shoe in an extreme situation.
Figure 5:
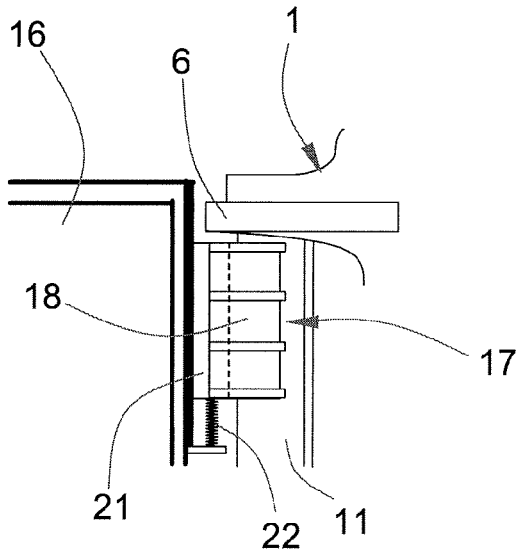

FIG. 3 and FIG. 5 show the guide device 17 according to the present invention with the guide shoe 18 that is displaceable by means of the linear guide 21 that is arranged on the elevator car 16 in an extreme situation. The elevator car 16 has traveled beyond the uppermost floor, upon which the guide shoe 18 is arrested by projecting hoistway equipment such as the console 6 and the elevator car 16 travels past the console 6. By means of the linear guide 21, the guide shoe 18 executes a relative displacement relative to the elevator car 16 whereby the returning spring 22 is compressed. The elevator car 16 or parts thereof utilize the hoistway headroom 19 that is defined by the drive unit 1 or other hoistway equipment.

The second guide shoe 18.1 and/or the fourth guide shoe 20.1 can also be arranged on a linear guide. This allows damage on occurrence of extreme situations in the hoistway pit to be avoided and/or hoistway pits of lesser depth to be realized. Depending on the disposition of the elevator, the third guide shoe 20 can also be executed moveably.

Figure 6:
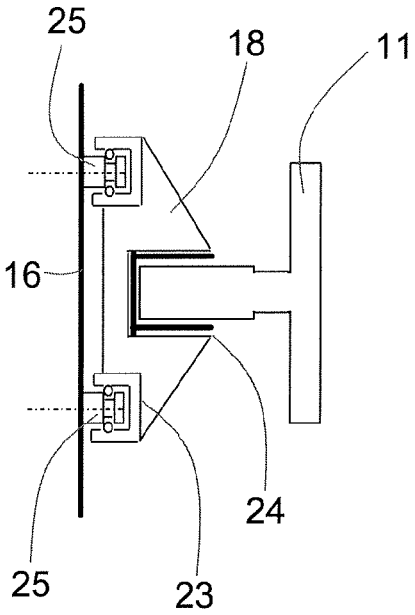
FIGS. 6, 7, and FIG. 8 are schematic views of alternate embodiments of the guide device according to the present invention.
Figure 7:
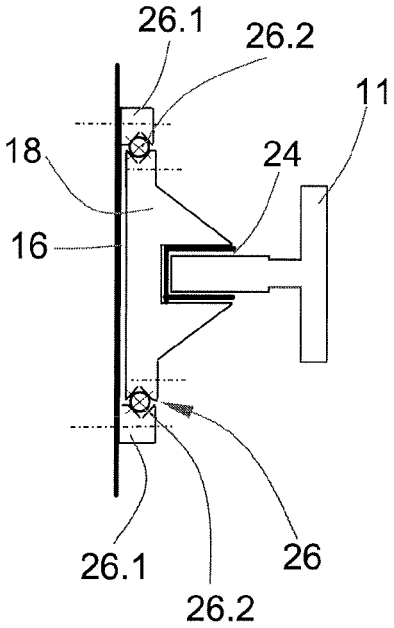
Figure 8:
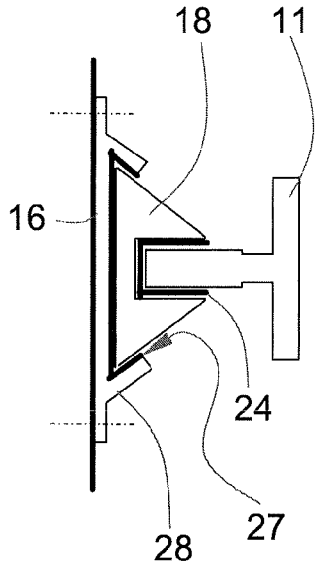

FIG. 6, FIG. 7, and FIG. 8 show variant embodiments of the linear guide 21. FIG. 6 shows the guide device 17 with a slipper guide shoe 18 that is embodied as a carriage 23, that by means of a sliding lining 24 is guided along the guide rail 11. The carriage 23 is moveably borne on carriage rails 25 that are connected to the elevator car 16. FIG. 7 shows the guide device 17 with a roller guide 26 on which the slipper guide shoe 18 is moveably borne that, by means of the sliding lining 24, is guided along the guide rail 11. The roller guide 26 consists of a roller housing 26.1 that is connected to the elevator car 16 and rollers 26.2 that roll on the roller housing 26.1 and on the slipper guide shoe 18. The roller housing 26.1, the rollers 26.2, and the rolling surface of the slipper guide shoe 18 form the linear guide 21. FIG. 8 shows the guide device 17 with a slipper guide shoe 18 that is moveably borne on a sliding lining 27 which by means of the sliding lining 24 is guided along the guide rail 11, the slipper guide shoe 18 sliding in a retainer 28 that is connected to the elevator car 16.

Figure 3A:
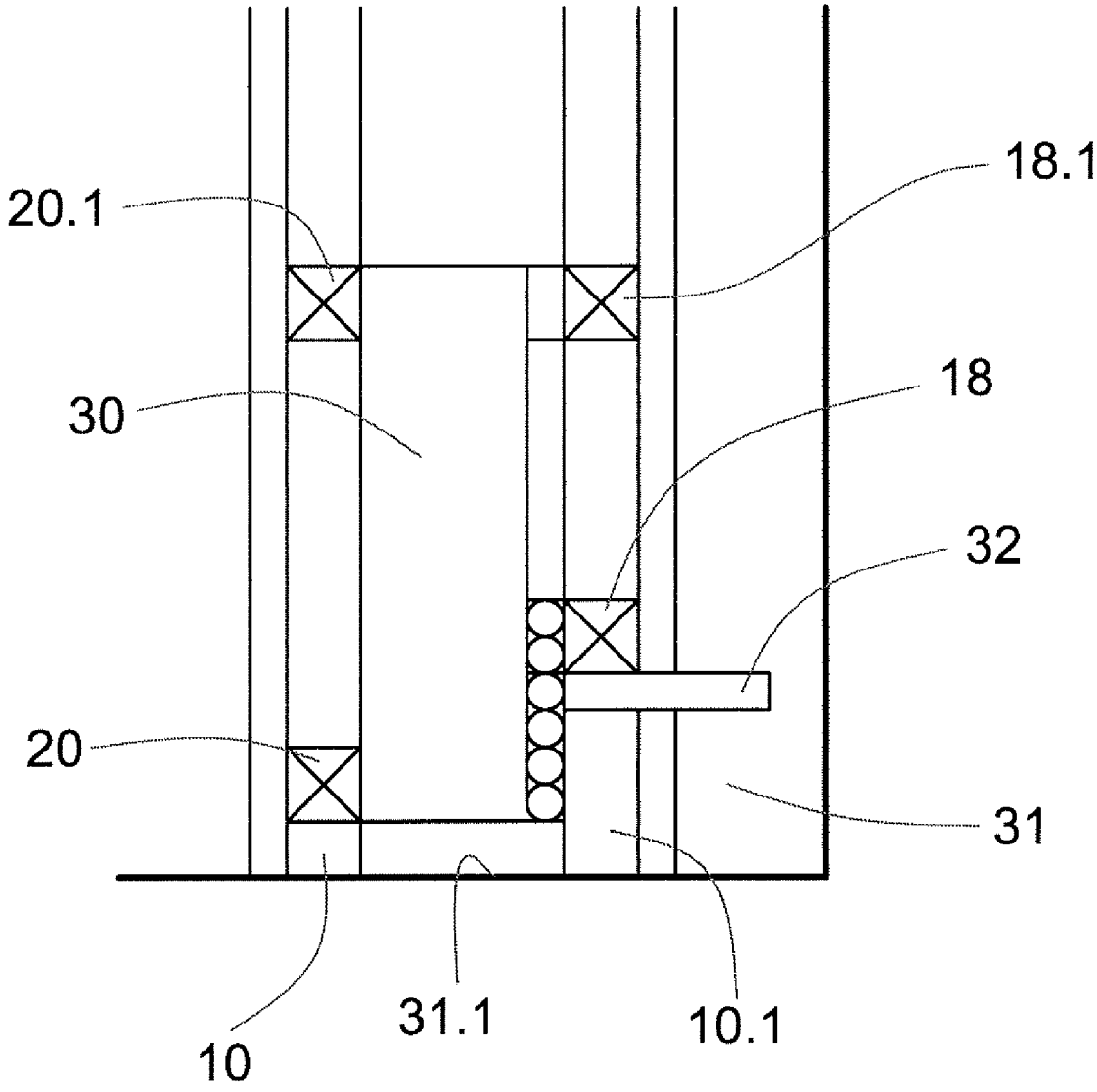
Figure 4:
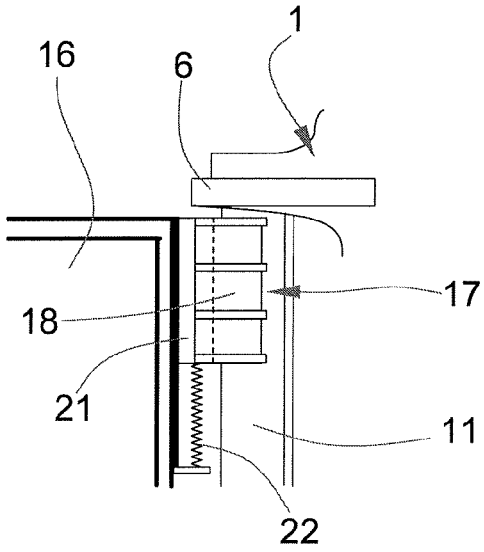

FIG. 3*a* shows the counterweight 30 with at least one guide shoe 18 that is moveable or displaceable relative to the counterweight 30 and guide shoes 18.1, 20, 20.1 that are fixed relative to the counterweight 30 as described above in an extreme situation in the hoistway pit 31. The counterweight 30 has traveled past hoistway equipment 32 that projects into the travel path of the guide shoe 18, whereupon the displaceable guide shoe 18 has been arrested by the hoistway equipment 32.

Instead of the slipper guide shoe 18, a roller guide shoe can also be provided.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A guide device for an elevator with an elevator car, a counterweight and a drive unit wherein suspension means that are guided over a traction sheave of the drive unit suspend and vertically move the elevator car and the counterweight that are guided on guide rails by guide shoes in a hoistway, comprising:

hoistway equipment fixed in the hoistway; and at least one of the guide shoes arranged on the elevator car or on the counterweight and being moveable in a vertical direction relative to the elevator car or the counterweight respectively upon contact with the hoistway equipment, wherein the elevator car or the counterweight moves vertically past said at least one guide shoe upon contact of said at least one guide shoe with the hoistway equipment.

2. The guide device according to claim 1 wherein said at least one guide shoe is arranged on a linear guide on the elevator car or the counterweight, said linear guide permitting said at least one guide shoe to move relative to the elevator car or the counterweight respectively.

3. The guide device according to claim 2 wherein said at least one guide shoe is arranged on a carriage that is borne moveably on carriage rails that are connected with the elevator car or the counterweight, said carriage and said carriage rails forming said linear guide.

4. The guide device according to claim 2 wherein said at least one guide shoe is borne moveably on a roller guide that is connected to the elevator car or the counterweight, a roller housing, rollers, and a rolling surface of said at least one guide shoe forming said linear guide.

5. The guide device according to claim 2 wherein said at least one guide shoe is borne displaceably on a sliding lining that is mounted displaceably, said sliding lining and a retainer connected to the elevator car or the counterweight forming said linear guide.

6. The guide device according to claim 1 including said at least one guide shoe attached at a top end of the elevator car and another guide shoe attached to a lower end of the elevator car and moveable in a vertical direction relative to the elevator car upon contact with the hoistway equipment, wherein the elevator car moves vertically past said another guide shoe upon contact of said another guide shoe with the hoistway equipment.

7. The guide device according to claim 1 including said at least one guide shoe attached at a top end of the counterweight and another guide shoe attached to a lower end of the counterweight and moveable in a vertical direction relative to the counterweight upon contact with the hoistway equipment, wherein the counterweight moves vertically past said another guide shoe upon contact of said another guide shoe with the hoistway equipment.

8. A method of operating an elevator with an elevator car, a counterweight and a drive unit wherein suspension means that are guided over a traction sheave of the drive unit suspend and vertically move the elevator car and the counterweight that are guided on guide rails by guide shoes in a hoistway comprising the steps of:

a. arranging at least one of the guide shoes on the elevator car or on the counterweight and being moveable only in a vertical direction relative to the elevator car or the counterweight respectively upon contact with hoistway equipment fixed in the hoistway;

b. wherein during normal operation of the elevator, said at least one guide shoe is positioned immovably relative to the elevator car or the counterweight; and c. when the elevator car or the counterweight moves adjacent the hoistway equipment said at least one guide shoe is displaced only vertically past the elevator car or the counterweight respectively upon contact with the hoistway equipment.

9. A guide device for an elevator with an elevator car, a counterweight and a drive unit wherein suspension means that are guided over a traction sheave of the drive unit suspend and vertically move the elevator car and the counterweight that are guided on guide rails by guide shoes in a hoistway, comprising:

hoistway equipment fixed in the hoistway;

at least one of the guide shoes arranged on the elevator car and being moveable only in a vertical direction relative to the elevator car upon contact with the hoistway equipment; and at least another of the guide shoes arranged on the counterweight and being moveable only in the vertical direction relative to the counterweight upon contact with the hoistway equipment, wherein the elevator car and the counterweight move vertically past the guide shoes upon contact of the respective guide shoes with the hoistway equipment.

* * * * *